US012264585B2

(12) United States Patent
Pastorino

(10) Patent No.: US 12,264,585 B2
(45) Date of Patent: Apr. 1, 2025

(54) FRICTION FIT DRILL BIT ASSEMBLY FOR A SELF-DRILLING ROCK BOLT

(71) Applicant: INNOVATIVE MINING PRODUCTS (PTY) LTD, Johannesburg (ZA)

(72) Inventor: Paolo Ettore Pastorino, Johannesburg (ZA)

(73) Assignee: INNOVATIVE MINING PRODUCTS (PTY) LTD, Johannesburg (ZA)

( * ) Notice: Subject to any disclaimer, the term of this patent is extended or adjusted under 35 U.S.C. 154(b) by 141 days.

(21) Appl. No.: 18/016,074

(22) PCT Filed: Jul. 15, 2021

(86) PCT No.: PCT/ZA2021/050042
§ 371 (c)(1),
(2) Date: Jan. 13, 2023

(87) PCT Pub. No.: WO2022/016200
PCT Pub. Date: Jan. 20, 2022

(65) Prior Publication Data

US 2023/0258086 A1 Aug. 17, 2023

(30) Foreign Application Priority Data

Jul. 15, 2020 (ZA) ..... 2020/04337

(51) Int. Cl.
*E21D 21/00* (2006.01)

(52) U.S. Cl.
CPC ..... *E21D 21/0053* (2016.01)

(58) Field of Classification Search
CPC ..... E21D 21/0026; E21D 21/0046; E21D 21/0053; E21B 17/04; E21B 17/046
See application file for complete search history.

(56) References Cited

U.S. PATENT DOCUMENTS 1,859,342 A * 5/1932 Rea ..... E21B 17/04 403/349
1,984,220 A * 12/1934 Lang ..... E21B 17/046 285/916

(Continued)

FOREIGN PATENT DOCUMENTS

AU 2018 201 286 3/2018

OTHER PUBLICATIONS

International Search Report for PCT/ZA2021/050042, mailed Nov. 18, 2021, 3 pages.

(Continued)

*Primary Examiner* — Benjamin F Fiorello
(74) *Attorney, Agent, or Firm* — NIXON & VANDERHYE

(57) ABSTRACT

The invention provides an adaptor for connecting a drill bit to a hollow shank of a self-drilling rock bolt, the adaptor including a body which extends in an axial direction between a distal end and a proximal end, a tubular conduit which extends between the ends, an abutment surface formed in an outer surface of the body that divides the body into a proximal portion and a distal portion, wherein at least a part of the proximal portion includes a first taper which tapers towards the proximal end, wherein at least a part of the distal portion includes a second taper which tapers towards the distal end, and wherein the first taper and the second taper are adapted for friction fit in a bore of the shank and a recess in the drill bit respectively.

2 Claims, 2 Drawing Sheets

(56) References Cited

U.S. PATENT DOCUMENTS

| | | | | |
|---|---|---|---|---|
| 2,569,275 | A * | 9/1951 | Baker | E21B 17/04 29/521 |
| 5,494,382 | A * | 2/1996 | Kloppers | E21B 17/04 408/199 |
| 8,708,607 | B2 * | 4/2014 | Kenny | E21D 21/0053 405/259.4 |
| 2007/0175671 | A1 * | 8/2007 | Nava | E21B 17/046 175/420.1 |
| 2011/0103896 | A1 * | 5/2011 | Horsch | E21B 10/42 405/259.1 |
| 2012/0125691 | A1 * | 5/2012 | Strydom | E21B 10/62 175/414 |
| 2012/0128444 | A1 * | 5/2012 | Podesser | F16B 13/141 411/50 |
| 2017/0335537 | A1 * | 11/2017 | Vasey | B63B 21/26 |
| 2018/0298697 | A1 * | 10/2018 | Anton | E21B 7/24 |

OTHER PUBLICATIONS

Written Opinion of the ISA for PCT/ZA2021/050042, mailed Nov. 18, 2021, 6 pages.

* cited by examiner 12
26
22
20
24
32
42
10
40
34
18
14

12
30
26
30
28
24
46
10
36
38
31
44
18
34
16

12
22
14

12
30
28
42
10
36
40
34
16

FRICTION FIT DRILL BIT ASSEMBLY FOR A SELF-DRILLING ROCK BOLT

This application is the U.S. national phase of International Application No. PCT/ZA2021/050042 filed Jul. 15, 2021, which designated the U.S. and claims priority to ZA Patent Application No. 2020/04337 filed Jul. 15, 2020, the entire contents of each of which are hereby incorporated by reference.

FIELD OF THE INVENTION

The invention relates to a self-drilling rock anchor with a drill bit which attaches to the rock anchor in friction fit. The means providing the friction fit may be integral with the drill bit or included in an adaptor.

BACKGROUND OF INVENTION

The drill bit of a hollow self-drilling rock anchor typically is threadedly engaged to one end of a hollow rod or bar. A part of the drill bit is formed with a female thread which engages with a male thread in a bore of the rod.

To ensure that the drill bit does not break from the rod during energetic use, the body of the drill bit must be of a sufficient diameter to have the requisite material thickness for the support of a thread.

With an increase in diameter comes an increase in the cutting face of the bit and an increase in the size of hole drilled which, often, is beyond that which is necessary for the particular application.

With a larger hole comes the requirement for more resin to fill that hole once the rock anchor has been installed. This comes at additional cost, whilst decreasing the stiffness of the installation.

An alternative method of attachment is to machine a taper onto the proximal end of the hollow rod. This tapered end then inserts into a complementary recess in the drill bit.

Again, if the rod is not sufficiently massive, the tapered end will not have enough inherent strength to withstand failure or plastic deformation during use involving high applied load.

The invention at least partially solves the aforementioned problems.

SUMMARY OF INVENTION

The invention provides an adaptor for connecting a drill bit to a hollow shank of a self-drilling rock bolt, the adaptor including a body which extends in an axial direction between a distal end and a proximal end, a tubular conduit which extends between the ends, an abutment surface formed in an outer surface of the body that divides the body into a proximal portion and a distal portion, wherein at least a part of the proximal portion includes a first taper which tapers towards the proximal end, wherein at least a part of the distal portion includes a second taper which tapers towards the distal end, and wherein the first taper and the second taper are adapted for friction fit in a bore of the shank and a recess in the drill bit respectively.

The invention also provides a friction fit drill bit kit which includes:

a drill bit which has a drill bit body which extends in an axial direction between a drill face end and a trailing end, which body includes a tapered recess in the trailing end and at least one tubule which opens the recess to the drill face end; and an adaptor, for connecting the drill bit and a hollow shank, of a self-drilling rock bolt, which includes a body which extends in the axial direction between a distal end and a proximal end, a tubular conduit which extends between the ends, a surface formed in an outer surface of the body that divides the body into a proximal portion and a distal portion, wherein at least a part of the proximal includes a first taper which tapers towards the proximal end, wherein at least a part of the distal portion includes a second taper which tapers towards the distal end, and wherein the first taper and the second taper are adapted for friction fit in a bore of the shank and the tapered recess of the drill bit respectively.

The invention extends to a drill bit which is adapted for friction fit engagement with a hollow shank of a self-drilling rock bolt, the drill bit including a drill bit body which extends in an axial direction between a drill face end and a trailing end, a tubular conduit which extends between the ends, an abutment surface formed in an outer surface of the body that divides the body into a proximal portion, which ends at the drill face end, and a distal portion, wherein at least a part of the distal portion includes a taper which tapers towards the trailing end and which is adapted for friction fit in a bore of the shank.

BRIEF DESCRIPTION OF THE DRAWINGS

The invention is described with reference to the following drawings in which.

DESCRIPTION OF PREFERRED EMBODIMENTS

Figures 1, 2, 3, 4:
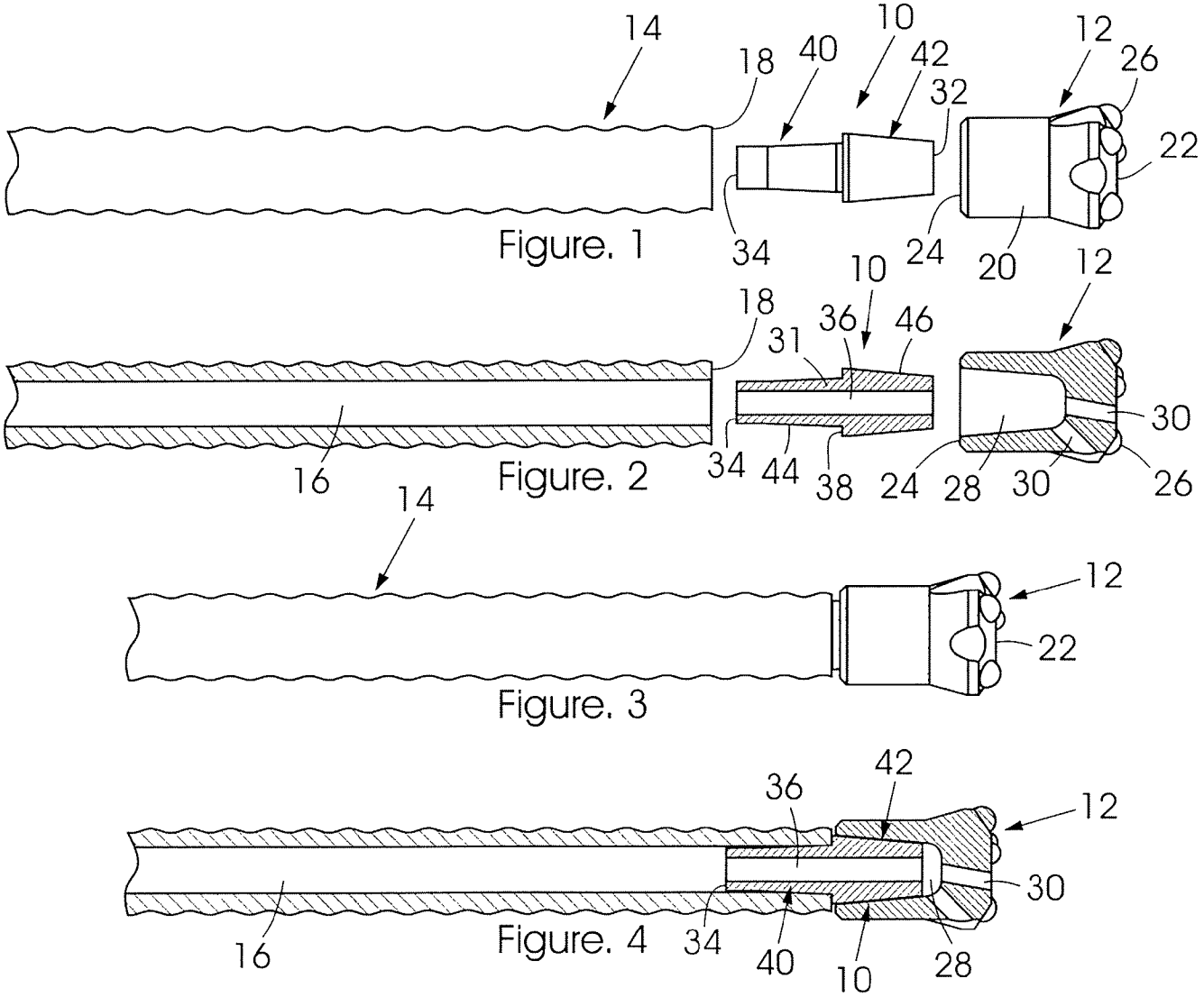
FIG. 1 is a view from the side of a disassembly of a self-drilling rock bolt, illustrating an adaptor, interposed between a hollow bolt and a drill bit, in accordance with the invention.
FIG. 2 is a view in longitudinal section of the disassembled self-drilling rock bolt of FIG. 1.
FIG. 3 is a view from the side of an assembly of the self-drilling rock bolt illustrated in FIG. 1.
FIG. 4 is a view in longitudinal section of the assembled self-drilling rock bolt of FIG. 3.
Figure 7:
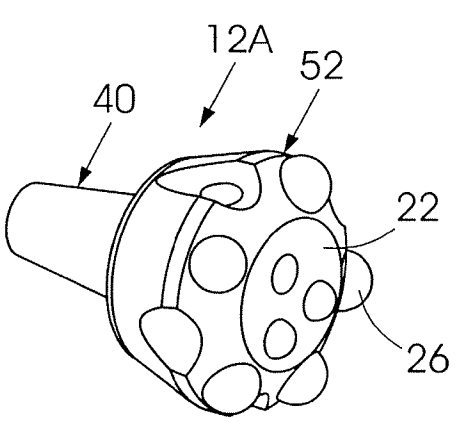
FIG. 7 is a view in perspective of the drill bit of FIGS. 5 and 6.
Figure 6:
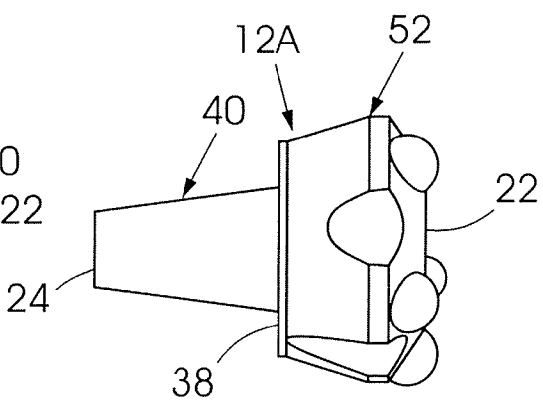
FIG. 6 is a view from the side of the drill bit of FIG. 5.
Figure 5:
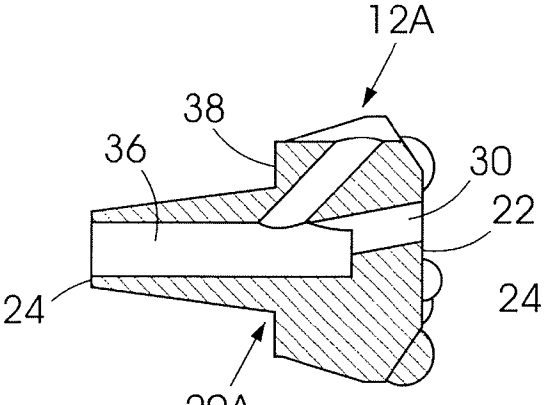
FIG. 5 is a view in longitudinal section of a drill bit in accordance with another aspect of the invention.

FIGS. 1, 2 and 4 illustrate an adaptor 10 in accordance with the invention for connecting a drill bit 12 to a hollow resin bolt or shank 14 in assembly of a self-drilling rock bolt.

The hollow resin bolt 14 is a typical steel bolt with a corrugated outer surface and a cylindrical bore 16 which extends longitudinally through the bolt, opening at a first end 18 and a second end (not shown) of the bolt. The bore is provided as a conduit for the passage of a resin and, following this, a flushing medium to flush away excess resin and debris after use.

The drill bit 12 has a largely cylindrical body 20 which extends, in the axial/longitudinal direction, between a drill face end 22 and a trailing end 24. Towards the drill face end, the body diverges outwardly, from a cylindrical shape, to a frusto-conical shape, ending at the drill face end which carries a plurality of abrasive protuberances 26.

A tapered recess 28 opens into the body 20 from the trailing end 24. A plurality of outlet tubules 30 open the recess to the drill face end 22.

The adapter 10 has an elongate body 31 which extends between a distal end 32 and a proximal end 34. A tubular conduit 36 passes through the body, opening at both these ends (32, 34).

At a mid-point along the body, the outer surface is stepped to provide a laterally extending abutment surface 38. This abutment surface faces the proximal end 34 and divides the adaptor into a proximal portion 40 and a distal portion 42.

At least part of the outer surface of the proximal portion narrows, in a first taper 44, from a junction line of the abutment surface 38 to or towards the proximal end 34.

Likewise, at least part of the outer surface of the distal portion 42 narrows, in a second taper 46, from an outer edge of the abutment surface to or towards the distal end 32.

In this example, the taper angle of the first taper 44 is smaller than the taper angle of the second taper 46 to complement the dimensions and shape of the bore 16, the bolt 14, and the tapered recess 28, of the drill bit 12, respectively.

As illustrated in FIG. 4, the proximal portion 40 of the adaptor 10 is inserted into the bore 16 from the bolt's first end 18, in assembly of a self-drilling rock bolt 50, in friction fit to the point at which the abutment surface 38 abuts or is positioned adjacent the first end.

The tight friction engagement of the proximal portion 40 within the bore, provided by the complementary shape of the first taper 44, creates a self-locking join that does not rotate and pull apart by the torque created in use.

Similarly, the distal portion 42 is inserted into the tapered recess 28 of the drill bit 12. With the tight taper tolerance between the second taper 46 and the tapered recess 28, a self-locking join is provided between the adaptor 10 and the drill bit 12.

As a self-drilling rock bolt (illustrated in FIGS. 3 and 4), the bore 16 of the bolt, the tubular conduit 36 of the adaptor, the tapered recess 28 and the outlet tubules 30 are in fluid communication providing continuous passage to a resin or flushing medium, input into the second end of the bolt, to exit at the drill face 22.

As an alternative means of engaging the drill bit 12 to the bolt 14 without a thread or a weld, the invention provides a drill bit 12A which is integrally provided with the tapered engagement means of the adaptor 10.

In describing this aspect of the invention, like features bear like designations.

The drill bit 12A has an elongated body 20A which extends between the drill face end 22 and a trailing end 24. A tubular conduit 36A extends between these ends.

As with the adaptor 10, at a mid-point along the body 12A, the outer surface is stepped, providing an abutment surface 38 which faces the trailing end 24.

This surface functionally divides the drill bit into a bolt engaging proximal portion 40 and a drill bit portion 52. The side wall of the drill bit portion diverges from the abutment surface in frusto-conical shape, terminating at the drill face end 22.

At least part of the outer surface of the proximal portion 40 narrows, in a taper, from the abutment surface to the proximal end.

Figure 8:
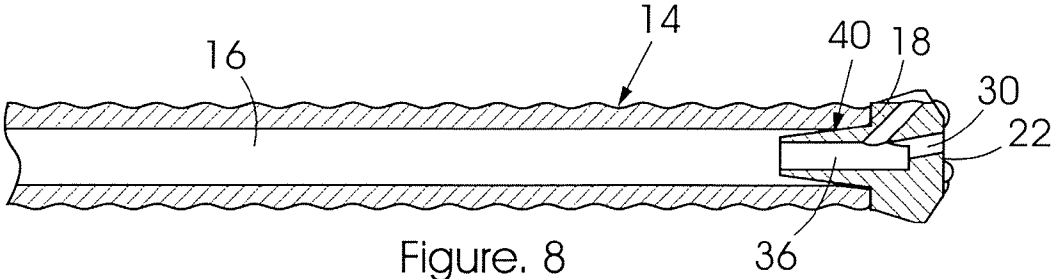
FIG. 8 is a view in longitudinal section of the drill bit of the preceding Figures engaged with a hollow bar to provide a self-drilling rock bolt.

As illustrated in FIG. 8, the proximal portion 40 of the drill bit 12A is inserted into the bore 16, from the bolt's first end 18, in friction fit, with the abutment surface 38 abutting or positioned adjacent the first end.

The tight friction engagement of the proximal portion 40 within the bore, provided by the complementary shape of the taper, creates a self-locking join that does not rotate and pull apart by the torque created in use.

Figure 9:
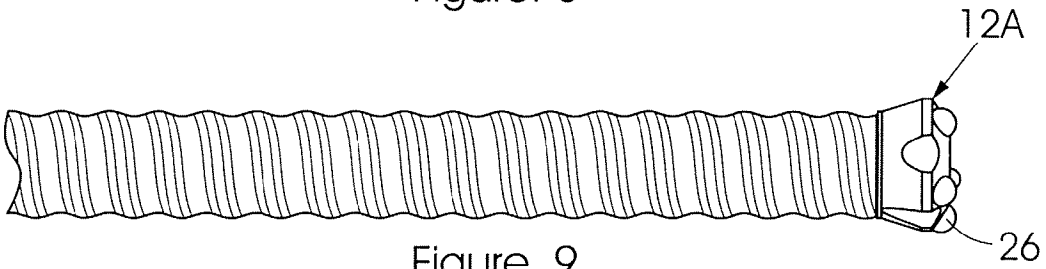
FIG. 9 is a view from the side of the self-drilling rock bolt of FIG. 8.

As a self-drilling rock bolt (illustrated in FIGS. 8 and 9), the bore 16 of the bolt, the tubular conduit 36A of the drill bit 12A and the outlet tubules 30 are in fluid communication providing continuous passage to a resin or flushing medium, input into the second end of the bolt, to exit at the drill face 22.

The invention claimed is:

1. An adaptor for connecting a drill bit to a hollow shank of a self-drilling rock bolt, the adaptor comprising:

a body which extends in an axial direction between a distal end and a proximal end;

a tubular conduit which extends between the distal and proximal ends; and an abutment surface formed in an outer surface of the body that divides the body into a proximal portion and a distal portion, wherein at least a part of the proximal portion includes a first taper with a first taper angle which tapers towards the proximal end, wherein at least a part of the distal portion includes a second taper with a second taper angle which tapers towards the distal end, and wherein the first taper angle is smaller than the second taper angle to provide friction fit of the first taper and the second taper with a bore of the shank and a recess in the drill bit respectively.

2. A friction fit drill bit kit comprising:

a drill bit which has a drill bit body which extends in an axial direction between a drill face end and a trailing end, the drill bit body comprising a tapered recess in the trailing end and at least one tubule which opens the tapered recess to the drill face end; and an adaptor configured to connect the drill bit to a hollow shank of a self-drilling rock bolt, the adaptor comprising:

a body which extends in the axial direction between a distal end and a proximal end;

a tubular conduit which extends between the distal and proximal ends; and a surface formed in an outer surface of the body that divides the body into a proximal portion and a distal portion, wherein at least a part of the proximal portion includes a first taper with a first taper angle which tapers towards the proximal end, wherein at least a part of the distal portion includes a second taper with a second taper angle which tapers towards the distal end, and wherein first taper angle is smaller than the second taper angle to provide friction fit of the first taper and the second taper in a bore of the shank and the tapered recess of the drill bit respectively.

* * * * *